US006757654B1

(12) United States Patent
Westerlund et al.

(10) Patent No.: US 6,757,654 B1
(45) Date of Patent: Jun. 29, 2004

(54) FORWARD ERROR CORRECTION IN SPEECH CODING

(75) Inventors: Magnus Westerlund, Kista (SE); Anders Nohlgren, Luleå (SE); Jonas Svedberg, Luleå (SE); Anders Uvliden, Luleå (SE); Jim Sundqvist, Luleå (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 09/569,312

(22) Filed: May 11, 2000

(51) Int. Cl.[7] ..... G10L 13/02

(52) U.S. Cl. ..... 704/262; 704/258; 704/219; 704/220

(58) Field of Search ..... 704/262, 219, 704/220, 258, 270, 221, 229

(56) References Cited

U.S. PATENT DOCUMENTS

| | | | | | |
|---|---|---|---|---|---|
| 4,360,708 | A | * | 11/1982 | Taguchi | 704/229 |
| 4,742,519 | A | * | 5/1988 | Abe | 714/755 |
| 4,802,171 | A | * | 1/1989 | Rasky | 714/747 |
| 5,079,771 | A | * | 1/1992 | Shimada | 714/789 |
| 5,323,424 | A | * | 6/1994 | Fazel et al. | 375/329 |
| 5,568,061 | A | * | 10/1996 | McClure | 326/13 |
| 5,598,506 | A | * | 1/1997 | Wigren | 704/233 |
| 5,701,311 | A | * | 12/1997 | Kapoor | 714/748 |
| 5,717,819 | A | * | 2/1998 | Emeott | 704/221 |
| 5,870,412 | A | * | 2/1999 | Matsumura et al. | 714/52 |
| 5,878,387 | A | * | 3/1999 | Oshikiri | 704/207 |

FOREIGN PATENT DOCUMENTS

WO WO00/18057 3/2000

OTHER PUBLICATIONS

Shrimali, G and Parhi, K.K. High–speed Arithmetic Coder/Decoder Architectures, Acoustics, Speech, and Signal Processing, 1993. ICASSP–93., 1993 IEEE International Conference on, vol.: 1, Apr. 27–30 1993, page: 361–364 vol. 1.*

Perkins, C., et al., "A Survey of Packet Loss Recovery Techniques for Streaming Audio", IEEE Network: The Magazine of Computer Communications, vol. 12, No. 5, Sep. 1998, pps. 40–48, XP002133605.

(List continued on next page.)

*Primary Examiner*—Richemond Dorvil
*Assistant Examiner*—Kinari Patel

(57) ABSTRACT

An improved forward error correction (FEC) technique for coding speech data provides an encoder module which primary-encodes an input speech signal using a primary synthesis model to produce primary-encoded data, and redundant-encodes the input speech signal using a redundant synthesis model to produce redundant-encoded data. A packetizer combines the primary-encoded data and the redundant-encoded data into a series of packets and transmits the packets over a packet-based network, such as an Internet Protocol (IP) network. A decoding module primary-decodes the packets using the primary synthesis model, and redundant-decodes the packets using the redundant synthesis model. The technique provides interaction between the primary synthesis model and the redundant synthesis model during and after decoding to improve the quality of a synthesized output speech signal. Such "interaction," for instance, may take the form of updating states in one model using the other model.

16 Claims, 5 Drawing Sheets

OTHER PUBLICATIONS

Vainio, J., et al., "GSM EFR Based Multi–Rate Codec Family", IEEE International Conference on Acoustics, Speech and Signal Processing, vol. 1, MAy 12–15, 1998, pps. 141–144, XP000854535.

"Digital Cellular Telecommunications System; Enhanced Full Rate (EFR) Speech Transcoding (GSM 06.60, Version 5.1.1)", European Telecommunications Standard Institute, Reference:DE/SMG–020660, Nov. 1996, pps. 1–51.

Hardman, V., et al., "Reliable Audio for Use over the Internet", Proc. INET, 1995, 4 pps.

Nahumi, D., et al., "An Improved 8 KB/S RCELP Coder", 1995 IEEE, pps. 39–40.

Perkins, C., et al., "RTP Payload For Redundant Audio Data Draft–ietf–avt–Redundancy–Revised–00.txt", Internet Draft, "lid–abstracts.txt" at ftp.ietf.org, Aug. 3, 1998, pps. 1–10.

* cited by examiner

FORWARD ERROR CORRECTION IN SPEECH CODING

BACKGROUND

The present invention relates to a system and method for performing forward error correction in the transmission of audio information, and more particularly, to a system and method for performing forward error correction in packet-based transmission of speech-coded information.

1. Speech Coding

The shortcomings of state-of-the-art forward error correction (FEC) techniques can best be appreciated by an introductory discussion of some conventional speech coding concepts.

1.1 Code-Excited Linear Predictive (CELP) Coding

FIG. 1 shows a conventional code-excited linear predictive (CELP) analysis-by-synthesis encoder 100. The encoder 100 includes functional units designated as framing module 104, linear prediction coding (LPC) analysis module 106, difference calculating module 118, error weighting module 114, error minimization module 116, and decoder module 102. The decoder module 102, in turn, includes a fixed codebook 112, a long-term predictor (LTP) filter 110, and a linear predictor coding (LPC) filter 108 connected together in cascaded relationship to produce a synthesized signal ŝ(n). The LPC filter 108 models the short-term correlation in the speech attributed to the vocal tracts, corresponding to the spectral envelope of the speech signal. It is be represented by:

$$1/A(z) = 1\Big/\left(1 - \sum_{i=1}^{p} a_i z^{-i}\right), \qquad \text{(Eq. 1)}$$

where p denotes the filter order and $a_i$ denotes the filter coefficients. The LTP filter 110, on the other hand, models the long-term correlation of the speech attributed to the vocal cords, corresponding to the fine periodic-like spectral structure of the speech signal. For example, it can have the form given by:

$$1/P(z) = 1\Big/\left(1 - \sum_{i=-1}^{1} b_i z^{-(D+i)}\right), \qquad \text{(Eq. 2)}$$

where D generally corresponds to the pitch period of the long-term correlation, and $b_i$ pertains to the filter's long-term gain coefficients. The fixed codebook 112 stores a series of excitation input sequences. The sequences provide excitation signals to the LTP filter 110 and LPC filter 108, and are useful in modeling characteristics of the speech signal which cannot be predicted with deterministic methods using the LTP filter 110 and LPC filter 108, such as audio components within music, to some degree.

In operation, the framing module 104 receives an input speech signal and divides it into successive frames (e.g., 20 ms in duration). Then, the LPC analysis module 106 receives and analyzes a frame to generate a set of LPC coefficients. These coefficients are used by the LPC filter 108 to model the short-term characteristics of the speech signal corresponding to its spectral envelope. An LPC residual can then be formed by feeding the input speech signal through an inverse filter including the calculated LPC coefficients. This residual, shown in FIG. 2, represents a component of the original speech signal that remains after removal of the short-term redundancy by linear predictive analysis. The distance between two pitch pulses is denoted "L" and is called the lag. The encoder 100 can then use the residual to predict the long-term coefficients. These long-term coefficients are used by the LTP filter 110 to model the fine spectral structure of the speech signal (such as pitch delay and pitch gain). Taken together, the LTP filter 110 and the LPC filter 108 form a cascaded filter which models the long-term and short-term characteristics of the speech signal. When driven by an excitation sequence from the fixed codebook 112, the cascaded filter generates the synthetic speech signal ŝ(n) which represents a reconstructed version of the original speech signal s(n).

The encoder 100 selects an optimum excitation sequence by successively generating a series of synthetic speech signals ŝ(n), successively comparing the synthetic speech signals ŝ(n) with the original speech signals s(n), and successively adjusting the operational parameters of the decoder module 102 to minimize the difference between ŝ(n) and s(n). More specifically, the difference calculating module 118 forms the difference (i.e., the error signal e(n)) between the original speech signal s(n) and the synthetic speech signal ŝ(n). An error weighting module 114 receives the error signal e(n) and generates a weighted error signal $e_w(n)$ based on perceptual weighting factors. The error minimization module 116 uses a search procedure to adjust the operational parameters of the speech decoder 102 such that it produces a synthesized signal ŝ(n) which is closest to the original signal s(n) as possible.

Upon arriving at an optimum synthesized signal ŝ(n), relevant encoder parameters are transferred over a transmission medium (not shown) to a decoder site (not shown). A decoder at the decoder site includes an identical construction to the decoder module 102 of the encoder 100. The decoder uses the transferred parameters to reproduce the optimized synthesized signal ŝ(n) calculated in the encoder 100. For instance, the encoder 100 can transfer codebook indices representing the location of the optimal excitation signal in the fixed codebook 112, together with relevant filter parameters or coefficients (e.g., the LPC and LTP parameters). The transfer of the parameters in lieu of a more direct representation of the input speech signal provides notable reduction in the bandwidth required to transmit speech information.

FIG. 3 shows a modification of the analysis-by-synthesis encoder 100 shown in FIG. 1. The encoder 300 shown in FIG. 3 includes a framing module 304, LPC analysis module 306, LPC filter 308, difference calculating module 318, error weighting module 314, error minimization module 316, and fixed codebook 312. Each of these units generally corresponds to the like-named parts shown in FIG. 1. In FIG. 3, however, the LTP filter 110 is replaced by the adaptive codebook 320. Further, an adder module 322 adds the excitation signals output from the adaptive codebook 320 and the fixed codebook 312.

The encoder 300 functions basically in the same manner as the encoder 100 of FIG. 1. In the encoder 300, however, the adaptive codebook 320 models the long-term characteristics of the speech signal. Further, the excitation signal applied to the LPC filter 308 represents a summation of an adaptive codebook 320 entry and a fixed codebook 312 entry.

1.2 GSM Enhanced Full Rate Coding (GSM-EFR)

The prior art provides numerous specific implementations of the above-described CELP design. One such implementation is the GSM Enhanced Full Rate (GSM-EFR) speech transcoding standard described in the European Telecommunication Standard Institute's (ETSI) "Global System for Mobile Communications: Digital Cellular Telecommunications Systems: Enhanced full Rate (EFR) Speech Transcoding (GSM 06.60)," November 1996, which is incorporated by reference herein in its entirety.

The GSM-EFR standard models the short-term properties of the speech signal using:

$$H(z) = 1/\hat{A}(z) = 1\Big/\left(1 + \sum_{i=1}^{m} \hat{a}_i z^{-i}\right), \quad \text{(Eq. 3)}$$

where $\hat{a}_i$ represents the quantified linear prediction parameters. The standard models the long-term features of the speech signal with:

$$1/B(z)=1/(1-g_p z^{-T}) \quad \text{(Eq. 4)},$$

where T pertains to the pitch delay and $g_p$ pertains to the pitch gain. An adaptive codebook implements the pitch synthesis. Further, the GSM-EFR standard uses a perceptual weighting filter defined by:

$$W(z)=(A(z/\gamma_1))/(A(z/\gamma_2)) \quad \text{(Eq. 5)},$$

where A(z) defines the unquantized LPC filter, and $\gamma_1$ and $\gamma_2$ represent perceptual weighting factors. Finally, the GSM-EFR standard uses adaptive and fixed (innovative) codebooks to provide an excitation signal. In particular, the fixed codebook forms an algebraic codebook structured based on an interleaved single-pulse permutation (ISPP) design. The excitation vectors consist of a fixed number of mathematically calculated pulses different from zero. An excitation is specified by selected pulse positions and signs within the codebook.

In operation, the GSM-EFR encoder divides the input speech signal into 20 ms frames, which, in turn, are divided into four 5 ms subframes. The encoder then performs LPC analysis twice per frame. More specifically, the GSM-EFR encoder uses an auto-correlation approach with 30 ms asymmetric windows to calculate the short-term parameters. No look-ahead is employed in the LPC analysis. Look-ahead refers to the use of samples from a future frame in performing analysis.

Each LP coefficient is then converted to Linear Spectral Pair (LSP) representation for quantization and interpolation using an LSP predictor. LSP analysis maps the filter coefficients onto a unit circle in the range of $-\pi$ to $\pi$ to produce Line Spectral Frequency (LSF) values. The use of LSF values provides better robustness and stability against bit errors compared to the use of LPC values. Further, the use of LSF values enables a more efficient quantization of information compared to the use of LPC values. GSM-EFR specifically uses the following predictor equation to calculate a residual that is then quantized:

$$LSF_{res}=LSF-LSF_{mean}-predFactor\cdot LSF_{prev,res} \quad \text{(Eq. 6)}.$$

The term $LSF_{res}$ refers to an LSF residual vector for a frame n. The quantity $(LSF-LSF_{mean})$ defines a mean-removed LSF vector at frame n. The term $(predFactor\cdot LSF_{prev,res})$ refers to a predicted LSF vector at frame n, wherein predFactor refers to a prediction factor constant and $LSF_{prev,res}$ refers to a second residual vector from the past frame (i.e., frame n−1). The decoder uses the inverse process, as per Eq. 7 below:

$$LSF=LSF_{res}+LSF_{mean}+predFactor\cdot LSF_{prev,res} \quad \text{(Eq. 7)}.$$

To achieve the predicted result, the previous residual $LSF_{prev,res}$ in the decoder must have the correct value. After reconstruction, the coefficients are converted into direct filter form, and used when synthesizing the speech.

The encoder then executes so-called open-loop pitch analysis to estimate the pitch lag in each half of the frame (every 10 ms) based on the perceptually weighted speech signal. Thereafter, the encoder performs a number of operations on each subframe. More specifically, the encoder computes a target signal x(n) by subtracting the zero input response of the weighted synthesis filter W(z)H(z) from the weighted speech signal. Then the encoder computes an impulse response h(n) of the weighted synthesis filter. The encoder uses the impulse response h(n) to perform so-called closed-loop analysis to find pitch lag and gain. Closed-loop search analysis involves minimizing the mean-square weighted error between the original and synthesized speech. The closed-loop search uses the open-loop lag computation as an initial estimate. Thereafter, the encoder updates the target signal x(n) by removing adaptive codebook contribution, and the encoder uses the resultant target to find an optimum innovation vector within the algebraic codebook. The relevant parameters of the codebooks are then scalar quantified using a codebook predictor and the filter memories are updated using the determined excitation signal for finding the target signal in the next subframe.

The encoder transmits two sets of LSP coefficients (comprising 38 bits), pitch delay parameters (comprising 30 bits), pitch gain parameters (comprising 16 bits), algebraic code parameters (comprising 140 bits), and codebook gain parameters (comprising 20 bits). The decoder receives these parameters and reconstructs the synthesized speech by duplicating the encoder conditions represented by the transmitted parameters.

1.3 Error Concealment (EC) in GSM-EFR Coding

The European Telecommunication Standard Institute (ETSI) proposes error concealment for use in GSM-EFR in "Digital Cellular Telecommunications System: Substitution and Muting of Lost Frames for Enhanced Full Rate (EFR) Speech Traffic Channels (GSM 06.61)," version 5.1.2, April 1997, which is incorporated herein by reference in its entirety. The referenced standard proposes an exemplary state machine having seven states, 0 through 6. A Bad Frame Indication (BFI) flag indicates whether the current speech frame contains an error (state=0 for no errors, and state=1 for errors). A Previous Bad Frame Indication (PrevBFI) flag indicates whether the previous speech frame contained errors (state=0 for no errors, and state=1 for errors). State 0 corresponds to a state in which both the current and past frames contain no errors (i.e., BFI=0, PrevBFI=0). The machine advances to state 1 when an error is detected in the current frame. (The error can be detected using an 8-bit cyclic redundancy check on the frame). The state machine successively advances to higher states (up to the maximum state of 6) upon the detection of further errors in subsequent frames. When a good (i.e., error-free) frame is detected, the state machine reverts back to state 0, unless the state machine is currently in state 6, in which case it reverts back to state 5.

The decoder performs different error concealment operations depending on the state and values of flags BFI and PrevBFI. The condition BFI=0 and PrevBFI=0 (within state 0) pertains to the receipt of two consecutive error-free frames. In this condition, the decoder processes speech parameters in the typical manner set forth in the GSM-EFR 6.60 standard. The decoder then saves the current frame of speech parameters.

The condition BFI=0 and PrevBFI=1 (within states 0 or 5) pertains to the receipt of an error-free frame after receiving a "bad" frame. In this condition, the decoder limits the LTP gain and fixed codebook gain to the values used for the last received good subframe. In other words, if the value of the current LTP gain ($g^P$) is equal to or less than the last good LTP gain received, then the current LTP gain is used. However, if the value of the current LTP gain is larger than the last good LTP gain received, then the value of the last LTP gain is used in place of the current LTP gain. The value for the gain of the fixed codebook is adjusted in a similar manner.

The condition BFI=1 (within any states 1 to 6, and PrevBFI=either 0 or 1) indicates that an error has been detected in the current frame. In this condition, the current LTP gain is replaced by the following gain:

$$g^P=\alpha_{state}(n)\cdot g^P(-1) \text{ if } g^P(-1)\leq \text{median, else}$$

$$g^P=\alpha_{state}(n)\cdot \text{median if } g^P(-1)>\text{median,} \quad \text{(Eq. 8)}$$

where $g^P$ designates the gain of the LTP filter, $\alpha_{state}(n)$ designates an attenuation coefficient which has a successively greater attenuating effect with increase in state n (e.g., $\alpha_{state}(1)=0.98$, whereas $\alpha_{state}(6)=0.20$), "median" designates the median of the $g^P$ values for the last five subframes, and $g^P(-1)$ designates the previous subframe. The value for the gain of the fixed codebook is adjusted in a similar manner.

In the above-described state (i.e., when BFI=1), the decoder also updates the codebook gain in memory by using the average value of the last four values in memory. Furthermore, the decoder shifts the past LSFs toward their mean, i.e.:

$$\text{LSF_}q1(i)=LSF_q2(i)=\beta\cdot \text{past_}LSF_q(i)+(1-\beta)\cdot \text{mean_}LSF(i) \quad \text{(Eq. 9)},$$

where LSF_q1(i) and LSF_q2(i) are two vectors from the current frame, β is a constant (e.g., 0.95), past_LSF_q(i) is the value of LSF_q2 from the previous frame, and mean_LSF(i) is the average LSF value. Still further, the decoder replaces the LTP-lag values by the past lag value from the 4th subframe. And finally, the fixed codebook excitation pulses received by the decoder are used as such from the erroneous frame.

1.4 Vocoders

FIG. 4 shows another type of speech decoder, the LPC-based vocoder 400. In this decoder, the LPC residual is created from noise vector 404 (for unvoiced sounds) or a static pulse form 406 (for voiced speech). A gain module 406 scales the residual to a desired level. The output of the gain module is supplied to an LPC filter block including LPC filter 408, having an exemplary function defined by:

$$A(z)=\sum_{i=1}^{n} a_i z^{-i}), \quad \text{(Eq. 10)}$$

where $a_i$ designates the coefficients of the filter which can be computed by minimizing the mean square of the prediction error. One known vocoder is designated as "LPC-10." This decoder was developed for the U.S. military to provide low bit-rate communication. The LPC-10 vocoder uses 22.5 ms frames, corresponding to 54 bits/frame equal and 2.4 kbits/s.

In operation, the LPC-10 encoder (not shown) makes a voicing decision to use either the pulse train or the noise signal. In the LPC-10, this can be performed by forming a low-pass filtered version of the sampled input signal. The decision is based on the energy of the signal, maximum-to-minimum ratio of the signal, and the number of zero crossings of the signal. Voicing decisions are made for each half of the current frame, and the final voicing decision is based on these two half-frame decisions and the decisions from the next two frames.

The pitch is determined from a low-pass and inverse-filtered signal. The pitch gain is determined from the root mean square value (RMS) of the signal. Relevant parameters characterizing the coding are quantized, sent to the decoder, and used to produce a synthesized signal in the decoder. More particularly, this coding technique provides coding with ten coefficients.

The vocoder 400 uses a simpler synthesis model than the GSM-EFR technique and accordingly uses less bits than the GSM-EFR technique to represent the speech, which, however, results in inferior quality. The low bit-rate makes vocoders suitable as redundant encoders for speech (to be described below). Vocoders work well modeling voiced and unvoiced speech, but do not accurately handle plosives (representing complete closure and subsequent release of a vocal tract obstruction) and non-speech information (e.g., music).

Further details on conventional speech coding can be gleaned from the book Digital Speech: Coding for Low Bit Rate Communication Systems, A. M. Kondoz, 1994, John Wiley & Sons, which is incorporated herein by reference in its entirety.

2. Forward Error Correction (FEC)

Once coded, a communication system can transfer speech in a variety of formats. Packet-based networks transfer the audio data in a series of discrete packets.

Packet-based traffic can be subject to high packet loss ratios, jitter and reordering. Forward error correction (FEC) is one technique for addressing the problem of lost packets. Generally, FEC involves transmitting redundant information along with the coded speech. The decoder attempts to use the redundant information to reconstruct lost packets. Media-independent FEC techniques add redundant information based on the bits within the audio stream (independent of higher-level knowledge of the characteristics of the speech stream). On the other hand, media-dependent FEC techniques add redundant information based on the characteristics of the speech stream.

U.S. Pat. No. 5,870,412 to Schuster et al. describes one media-independent technique. This method appends a single forward error correction code to each of a series of payload packets. The error correction code is defined by taking the XOR sum of a preceding specified number of payload packets. A receiver can reconstruct a lost payload from the redundant error correction codes carried by succeeding packets, and can also correct for the loss of multiple packets in a row. This technique has the disadvantage of using a variable delay. Further, the XOR result must be of the same size as the largest payload used in the calculation.

FIG. 5 shows an overview of a media-based FEC technique. The encoder module 502 includes a primary encoder 508 and a redundant encoder 510. A packetizer 516 receives the output of the primary encoder 508 and the redundant encoder 510, and, in turn, sends its output over transmission medium 506. A decoder module 504 includes primary decoder 512 and redundant decoder 514. The output of the primary decoder 512 and redundant decoder 514 is controlled by control logic 518.

In operation, the primary encoder 508 generates primary-encoded data using a primary synthesis model. The redundant encoder 510 generates redundant-encoded data using a redundant synthesis model. The redundant synthesis model typically provides a more heavily-compressed version of the speech than the primary synthesis model (e.g., having a consequent lower bandwidth and lower quality). For instance, one known approach uses PCM-encoded data as primary-encoded speech, and LPC-encoded data as redundant-encoded speech (note, for instance, V. Hardman et al., "Reliable Audio for Use Over the Internet," Proc. INET'95, 1995). The LPC-encoded data has a much lower bit rate than the PCM-encoded data.

FIG. 6 shows how redundant data (represented by shaded blocks) may be appended to primary data (represented by non-shaded blocks). For instance, with reference to the topmost row of packets, the first packet contains primary data for frame n. Redundant data for the previous frame, i.e., frame n−1, is appended to this primary data. In this manner, the redundant data within a packet always refers to previously transmitted primary data. The technique provides a single level of redundancy, but additional levels may be provided (by transmitting additional copies of the redundant data).

Specific formats have been proposed for appending the redundant data to the primary data payload. For instance, Perkins et al. proposes a specific format for appending LPC-encoded redundant data to primary payload data within the Real-time Transport Protocol (RTP) (e.g., note C. Perkins et al., "RTP Payload for Redundant Audio Data," RFC 2198, September 1997). The packet header includes information pertaining to the primary data and information pertaining to the redundant data. For instance, the header includes a field for providing the timestamp of the primary encoding, which indicates the time of primary-encoding of the data. The header also includes an offset timestamp, which indicates the difference in time between the primary encoding and redundant encoding represented in the packet.

With reference to both FIGS. 5 and 6, the decoder module 504 receives the packets containing both primary and redundant data. The decoder module 504 includes logic (not shown) for separating the primary data from the redundant data. The primary decoder 512 decodes the primary data, while the redundant decoder 514 decodes the redundant data. More specifically, the decoder module 504 decodes primary-data frame n when the next packet containing the redundant data for frame n arrives. This delay is added on playback and is represented graphically in FIG. 6 by the legend "Extra delay." In the prior art technique, the control logic 518 instructs the decoder module 504 to use-the synthesized speech generated by the primary decoder 512 when a packet is received containing primary-encoded data. On the other hand, the control logic 518 instructs the decoder module 504 to use synthesized speech generated by the redundant decoder 514 when the packet containing primary data is "lost." In such a case, the control logic 518 simply serves to fill in gaps in the received stream of primary-encoded frames with redundant-encoded frames. For example, in the above-referenced technique described in Hardman et al., the decoder will decode the LPC-encoded data in place of the PCM-encoded data upon detection of packet loss in the PCM-encoded stream.

The use of conventional FEC to improve the quality of packet-based audio transmission is not fully satisfactory. For instance, speech synthesis models use the parameters of past operational states to generate accurate speech synthesis in present operational states. In this sense, the models are "history-dependent." For example, an algebraic code-excited linear prediction (ACELP) speech model uses previously produced syntheses to update its adaptive codebook. The LPC filter, error concealment histories, and various quantization-predictors also use previous states to accurately generate speech in current states. Thus, even if a decoder can reconstruct missing frames using redundant data, the "memory" of the primary synthesis model is deficient due to the loss of primary data. This can create "lingering" problems in the quality of speech synthesis. For example, a poorly updated adaptive codebook can cause distorted waveforms for more than ten frames. Conventional FEC techniques do nothing to address these types of lingering problems.

Furthermore, FEC-based speech coding techniques may suffer from a host of other problems not heretofore addressed by FEC techniques. For instance, in analysis-by-synthesis techniques using linear predictors, phase discontinuities may be very audible. In techniques using an adaptive codebook, a phase error placed in the feedback loop may remain for numerous frames. Further, in speech encoders using LP coefficients that are predicted when encoded, a loss of the LPC parameter lowers the precision of predictor. This will introduce errors into the most important parameter in an LPC speech coding technique.

SUMMARY

It is accordingly a general objective of the present invention to improve the quality of speech produced using the FEC technique.

This and other objectives are achieved by the present invention through an improved FEC technique for coding speech data. In the technique, an encoder module primary-encodes an input speech signal using a primary synthesis model to produce primary-encoded data, and redundant-encodes the input speech signal using a redundant synthesis model to produce redundant-encoded data. A packetizer combines the primary-encoded data and the redundant-encoded data into a series of packets and transmits the packets over a packet-based network, such as an Internet Protocol (IP) network. A decoding module primary-decodes the packets using the primary synthesis model, and redundant-decodes the packets using the redundant synthesis model. The technique provides interaction between the primary synthesis model and the redundant synthesis model during and after decoding to improve the quality of the synthesized output speech signal. Such "interaction," for instance, may take the form of updating states in one model using the other model.

Further, the present technique takes advantage of the FEC-staggered coupling of primary and redundant frames (i.e., the coupling of primary data for frame n with redundant data for frame n−1) to provide look-ahead processing at the encoder module and the decoder module. The look-ahead processing supplements the available information regarding the speech signal, and thus improves the quality of the output synthesized speech.

The interactive cooperation of both models to code speech signals greatly expands the use of redundant coding heretofore contemplated by conventional systems.

BRIEF DESCRIPTION OF THE DRAWINGS

The foregoing, and other, objects, features and advantages of the present invention will be more readily understood upon reading the following detailed description in conjunction with the drawings in which.

DETAILED DESCRIPTION

Figure 1:
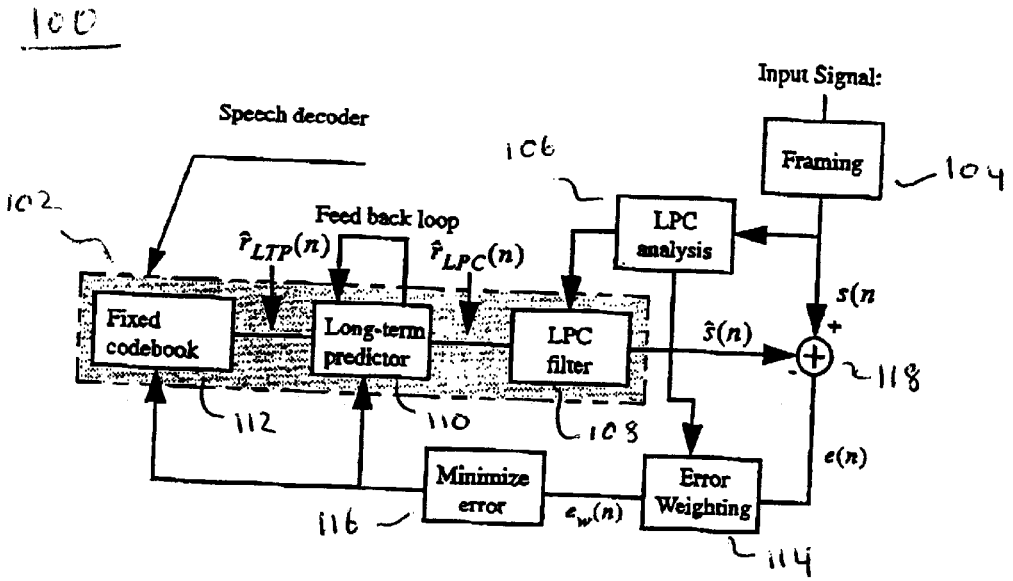
Fig. 1 (PRIOR ART)
FIG. 1 shows a conventional code-excited linear prediction (CELP) encoder.
Figure 2:
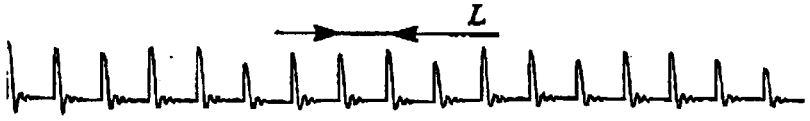
Fig. 2 (PRIOR ART)
FIG. 2 illustrates a residual generated by the CELP encoder of FIG. 1.
Figure 3:
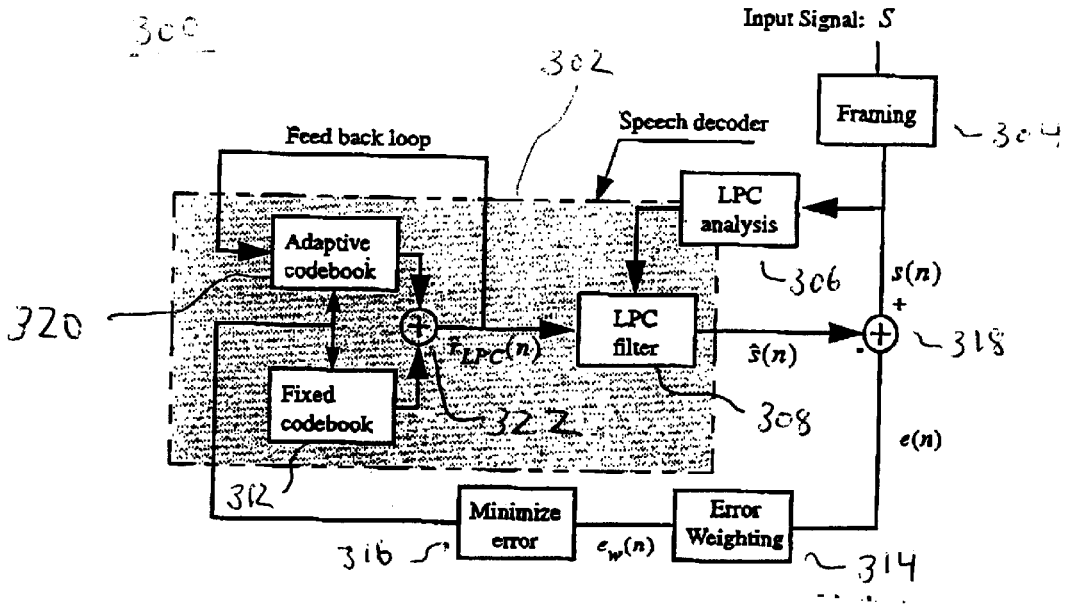
Fig. 3 (PRIOR ART)
FIG. 3 shows another type of CELP encoder using an adaptive codebook.

In the following description, for purposes of explanation and not limitation, specific details are set forth in order to provide a thorough understanding of the invention. However it will be apparent to one skilled in the art that the present invention may be practiced in other embodiments that depart from these specific details. In other instances, detailed descriptions of well-known methods, devices, and circuits are omitted so as not to obscure the description of the present invention with unnecessary detail. In the drawings, like numerals represent like features.

The invention generally applies to the use of forward error correction techniques to process audio data. To facilitate discussion, however, the following explanation is framed in the specific context of speech signal coding.

1. Overview

Figure 7:
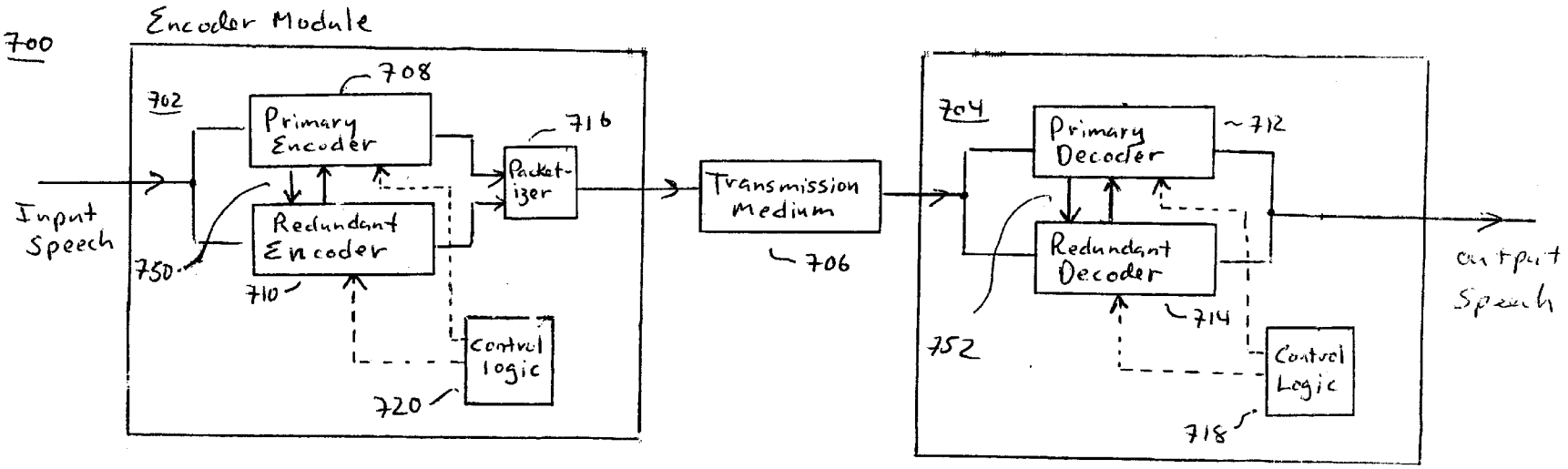
FIG. 7 shows a system for performing forward error correction in a packetized network according to one example of the present invention.

FIG. 7 shows an overview of an exemplary system 700 for implementing the present invention, including an encoder module 702 and a decoder module 704. The encoder module 702 includes a primary encoder 708 for producing primary-encoded data and a redundant encoder 710 for producing redundant-encoded data. Control logic 720 in the encoder module 702 controls aspects of the operation of the primary encoder 708 and redundant encoder 710. A packetizer 716 receives output from the primary encoder 708 and redundant encoder 710 and, in turn, transmits the primary-encoded data and redundant-encoded data over transmission medium 706. The decoder module 704 includes a primary decoder 712 and a redundant decoder 714, both controlled by control logic 718. Further, the decoder module 704 includes a receiving buffer (not shown) for temporarily storing a received packet at least until the received packet's redundant data arrives in a subsequent packet.

In operation, the primary encoder 708 encodes input speech using a primary coding technique (based on a primary synthesis model), and the redundant encoder 710 encodes input speech using a redundant coding technique (based on a redundant synthesis model). Although not necessary, the redundant coding technique typically provides a smaller bandwidth than the primary coding technique. The packetizer 716 combines the primary-encoded data and the redundant-encoded data into a series of packets, where each packet includes primary and redundant data. More specifically, the packetizer 716 can use the FEC technique illustrated in FIG. 6. In this technique, a packet containing primary data for a current frame, i.e., frame n, is combined with redundant data pertaining to a previous frame, i.e., frame n−1. The technique provides a single level of redundancy. The packetizer 716 can use any known packet format to combine the primary and redundant data, such as the format proposed by Perkins et al. discussed in the Background section (e.g., where the packet header includes information pertaining to both primary and redundant payloads, including timestamp information pertaining to both payloads).

After assembly, the packetizer 716 forwards the packets over the transmission medium 706. The transmission medium 706 can represent any packet-based transmission system, such as an Internet Protocol (IP) network. Alternatively, instead of transmission, the system 700 can simply store the packets in a storage medium for later retrieval.

The decoder module 704 receives the packets and reconstructs the speech information using primary decoder 712 and redundant decoder 714. The decoder module 704 generally uses the primary decoder 712 to decode the primary data and the redundant decoder 714 to decode the redundant data when the primary data is not available. More specifically, the control logic 718 can employ a state machine to govern the operation of the primary decoder 712 and redundant decoder 714. Each state in the state machine reflects a different error condition experienced by the decoder module 704. Each state also defines instructions for decoding a current frame of data. That is, the instructions specify different decoding strategies for decoding the current frame appropriate to different error conditions. More specifically, the strategies include the use of the primary synthesis model, the use of redundant synthesis model, and/or the use of an error concealment algorithm. The error conditions depend on the coding strategy used in the previous frame, the availability of primary and redundant data in the current frame, and the receipt or non-receipt of the next packet. The receipt or non-receipt of packets triggers the transitions between states.

Unlike conventional systems, the system 700 provides several mechanisms for providing interaction between the primary and redundant synthesis models. More specifically, the encoder-module control logic 720 includes control mechanisms for providing interaction between the primary and redundant synthesis models used by the primary and redundant encoders (i.e., encoders 708 and 710), respectively. Likewise, the decoder-module control logic 718 includes control mechanisms for providing interaction between the primary and redundant synthesis models used by the primary and redundant decoders (i.e., decoders 712 and 714), respectively. FIG. 7 graphically shows the interaction between the primary encoder 708 and redundant decoder 710 using arrows 750, and the interaction between primary decoder 712 and redundant decoder 714 using arrows 752.

The following sections present an overview of the features used in system 700 which provide the above-described interaction between primary and redundant synthesis models, as well as other new FEC speech-coding features.

1.1 Updating of States in the Decoder Module

As discussed in the Background section, conventional FEC techniques function by rudimentarily substituting redundant-decoded data for missing primary-decoded data, but do nothing to update the "memory" of the primary synthesis model to reflect the loss of the primary data. To address this problem, the present invention uses information gleaned from the redundant synthesis model to update the state(s) of the primary synthesis model. Similarly, the decoder module 704 can remedy "memory" deficiencies in the redundant synthesis model using parametric information gained from the primary synthesis model. Thus, generally speaking, the two models "help each other out" to furnish missing information. In contrast, in conventional FEC, the models share no information.

The specific strategy used to update the models depends, of course, on the requirements of the models. Some models may have more demanding dependencies on past states than others. It also depends on the prevailing error conditions present at the decoder module 704. To repeat, the error conditions are characterized by the strategy used in the previous frame to decode the speech (e.g., primary, redundant, error concealment), the availability of data in the current frame (e.g., primary or redundant), and the receipt or non-receipt of the next frame. Accordingly, the decoding instructions associated with each state of the state machine, which are specific to the error conditions, preferably also define the method for updating the synthesis models. In this manner, the decoder module 704 tailors the updating strategy to the prevailing error conditions.

A few examples will serve to illustrate the updating feature of the present invention. Consider, for instance, the state in which the decoder module 704 has not received the current frame's primary data (i.e., the primary data is lost), but has received the next frame's packet carrying redundant data for the current frame. In this state, the decoder module 704 decodes the speech based on the redundant data for the current frame. The decoded values are then used to update the primary synthesis model. A CELP-based model, for instance, may require updates to its adaptive codebook, LPC filter, error concealment histories, and various quantization-predictors. Redundant parameters may need some form of converting to suit the parameter format used in the primary decoder.

Consider the specific case in which the decoder module 704 uses a primary synthesis model based on GSM-EFR coding. As discussed in the Background section, the GSM-EFR model uses a quantization-predictor to reduce the dynamic of the LPC parameters prior to quantization. The decoder module 704 in this case also uses a redundant synthesis model which does not employ an quantization-predictor, and hence provides "absolute" encoded LPCs. In the present approach, the primary synthesis model provides information pertaining to LSF residuals (i.e, $LSF_{res}$), while the redundant model provides information pertaining to absolute LSF values for these coefficients (i.e., $LSF_{red}$.). The decoder module 704 uses the residual and absolute values to calculate the predictor state using Eq. 11 below, to therefore provide a quick predictor update:

$$LSF_{prev,res}=(LSF_{red}-LSF_{mean}-LSF_{res})/\text{predFactor} \quad \text{(Eq. 11)},$$

where the term $LSF_{mean}$ defines a mean LSF value, the term predFactor refers to a prediction factor constant, and $LSF_{prev,res}$ refers to a residual LSF from the past frame (i.e., frame n−1). The decoder module 704 uses the updated predictor state to decode the LSF residuals to LPC coefficients (e.g., using Eq. 7 above).

The use Eq. 11 is particularly advantageous when the predictor state has become insecure due to packet loss(es).

1.2 Decoder Module Look-ahead

Figure 6:
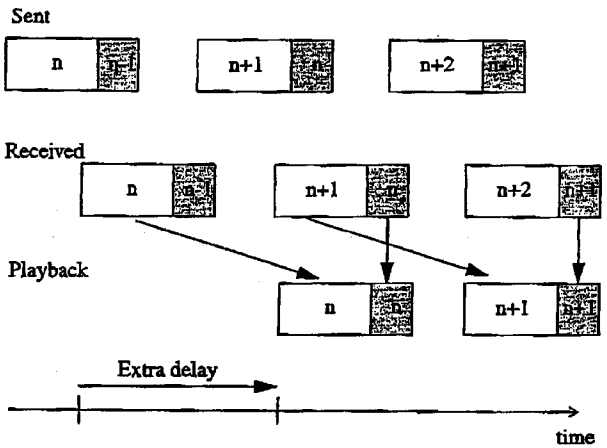
Fig. 6 (PRIOR ART)
FIG. 6 shows an example of the combination of primary and redundant information in the system of FIG. 5.

As illustrated in FIG. 6, the decoder module 704 must delay decoding of the primary data contained in a packet until it receives the next packet. The delay between the receipt and decoding of the primary data allows the decoder module 704 to use the primary data for any type of pre-decoding processing to improve the quality of speech synthesis. This is referred to here as "decoder look-ahead." For example, consider the case where the decoder module 704 fails to receive the packet containing primary-encoded frame n, but subsequently receives the packet containing the primary-encoded data for frame n+1, which includes the redundant-encoded data for frame n. The decoder module 704 will accordingly decode the data for frame n using redundant data. In the meantime, the decoder module 704 can use the primary data for frame n+1 (yet to be decoded) for look-ahead processing. For instance, the primary data for frame n+1 can be used to improve interpolation of energy levels to provide a smoother transition between frame n and frame n+1. The look-ahead can also be used in LPC interpolation to provide more accurate interpolation results near the end of the frame.

1.3 Encoder Module Look-Ahead

As previously explained, the packetizer 716 of encoder module 702 combines primary data pertaining to a current frame with redundant data pertaining to a previous frame; e.g., the packetizer combines primary data pertaining to frame n with redundant data pertaining to frame n−1. Accordingly, the encoder module 702 must delay the transmission of redundantly-encoded data by one frame. Due to this one frame delay, the redundant encoder 710 can also delay its encoding of the redundant data such that all of the data (primary and redundant) combined in a packet is decoded at the same time. For example, the encoder module 702 could encode the redundant data for frame n−1 at the same time it encodes the primary data for frame n. Accordingly, the redundant data is available for a short time prior to decoding. The advance availability of the redundant data (e.g., redundant frame n−1) provides opportunities for look-ahead processing. The results of the look-ahead processing can be used to improve the subsequent redundant-processing of the frame. For instance, the voicing decision in a vocoder synthesis model (serving as the redundant synthesis model) can be improved through the use of look-ahead data in its calculation. This will result in fewer erroneous decisions regarding when a voiced segment actually begins.

Look-ahead in the encoder module 702 can be implemented in various ways, such as through the use of control logic 720 to coordinate interaction between the primary encoder 708 and the redundant encoder 710.

1.4 Maintaining Pitch Pulse Phase

The pitch phase (i.e., pitch pulse position) provides useful information for performing the FEC technique. In a first case, the decoder module 704 identifies the location of the last pulse in the adaptive codebook pertaining to the previous frame. More specifically, the module 704 can locate the pitch pulse position by calculating the correlation between the adaptive codebook and a predetermined pitch pulse. The pitch pulse phase can then be determined by locating the correlation spike or spikes. Based on knowledge of the location of the last pulse and the pitch lag, the decoder module 704 then identifies the location where the succeeding pulse should be placed in the current frame. It does this by moving forward one or more pitch periods into the new frame from the location of the last pulse. One specific application of this technique is where GSM-EFR serves as the primary decoder and a vocoder-based model serves as the redundant decoder. The decoder module 704 will use the redundant data upon failure to receive the primary data. In this circumstance, the decoder module 704 uses the technique to place the vocoder pitch pulse based on the phase information extracted from the adaptive codebook. This helps ensure that a vocoder pitch pulse is not placed in a completely incorrect period.

In a second case, the encoder module 702 determines and transmits information pertaining to the pitch phase of the original speech signal (such as pitch pulse position and pitch pulse sign) in the redundant coding. Again, this information can be obtained by calculating the correlation between the adaptive codebook and a predetermined pitch pulse. Upon receipt, the decoder module 704 can compare the received pitch phase information with pitch phase information detected using the adaptive codebook (calculated in the manner described above). A difference between the redundant-coded pitch phase information and the adaptive codebook pitch phase information constitutes a phase discontinuity. To address this concern, the technique can adjust pitch periods over the course of the current frame with the aim of providing the correct phase at the end of the frame. As a consequence, the adaptive codebook will receive the correct phase information when it is updated. One specific application of this technique is where the GSM-EFR technique serves as the primary decoder and a vocoder-based model serves the redundant decoder. Again, the decoder module 704 will use the redundant data upon failure to receive the primary data. In this circumstance, the vocoder receives information regarding the pulse position and sign from the redundant encoder. It then computes the location where the pulse should occur from the adaptive codebook in the manner described above. Any phase difference between the received location and the computed location is smoothed out over the frame so that the phase will be correct at the end of the frame. This will ensure that the decoder module 704 will have correct phase information stored in the adaptive codebook upon return to the use of primary-decoding (e.g., GSM-EFR decoding) in the next frame.

As an alternative to the second case, the redundant decoder receives no information regarding the pulse position from the encoder site. Instead, it computes the the pulse position from the decoded primary data in the next frame. This is done by extracting pulse phase information from the next primary frame and then stepping back into the current frame to determine the correct placement of pulses in the current frame. This information is then compared with another indication of pulse placement calculated from the previous frame as per the method described above. Any discrepancies in position can be corrected as per the method described above (e.g., by smoothing out phase error over the course of the current frame, so that the next frame will have the correct phase, as reflected in the adaptive codebook).

1.5 Alternative Selection of Redundant Parameters

Figure 8:
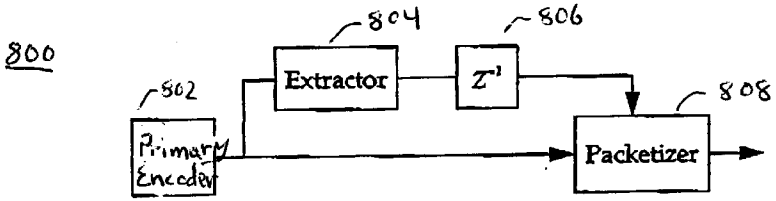
FIG. 8 shows an example of an encoder module for use in the present invention.

FIG. 8 shows an alternative encoder module 800 for use in the FEC technique. The encoder 800 includes a primary encoder 802 connected to a packetizer 808. An extractor 804 extracts parametric information from the primary encoder 802. A delay module 806 delays the extracted parameters by, e.g., one frame. The delay module 806 forwards the delayed redundant parameters to the packetizer 808.

In operation, the extractor 804 selects a subset of parameters from the primary-encoded parameters. The subset should be selected to enable the creation of synthesized speech from the redundant parameters, and to enable updating of states in the primary synthesis model when required. For instance, LPC, LTP lag, and gain values would be suitable for duplication in an analysis-by-synthesis coding technique. In one case, the extractor extracts all of the parameters generated by the primary encoder. These parameters can be converted to a different format for representing the parameters with reduced bandwidth (e.g., by quantizing the parameters using a method which requires fewer bits than the primary synthesis model used by the primary encoder 802). The delay module 806 delays the redundant parameters by one frame, and the packetizer combines the delayed redundant parameters with the primary-encoded parameters using, e.g., the FEC protocol illustrated in FIG. 6.

2. Example 2.1 Primary and Redundant Coders for Use with FEC

The GSM-EFR speech coding standard, discussed in the Background section, can be used to code the primary stream of speech data. The GSM-EFR standard is further described in "Global System for Mobile Communications: Digital Cellular Telecommunications Systems: Enhanced Full Rate (EFR) Speech Transcoding (GSM 06.60)," November 1996. As described above, the GSM-EFR speech coding standard uses an algebraic code excited linear prediction (ACELP) coder. The ACELP of the GSM-EFR codes a 20 ms frame containing 160 samples, corresponding to 244 bits/frame and an encoded bitstream of 12.2 kbits/s. Further, the primary encoder uses the error concealment technique described in "Digital Cellular Telecommunications System: Substitution and Muting of Lost Frames for Enhanced Full Rate (EFR) Speech Traffic Channels (GSM 06.61)," version 5.1.2, April 1997 (also summarized above).

A vocoder can be used to code the redundant stream of speech data. The vocoder used in this example incorporates some features of the LPC-10 vocoder discussed in the Background section, and other features of the GSM-EFR system. The GSM-EFR-based features render the output of the vocoder more readily compatible with the primary data generated by the GSM-EFR primary encoder. For instance, the LPC-10 vocoder uses 22.5 ms frames, whereas the GSM-EFR encoder uses 20 ms frames. Accordingly, the hybrid design incorporates the use of 20 ms frames. The hybrid vocoder designed for this FEC application is referred to as a "GSM-VOC" vocoder.

Figure 4:
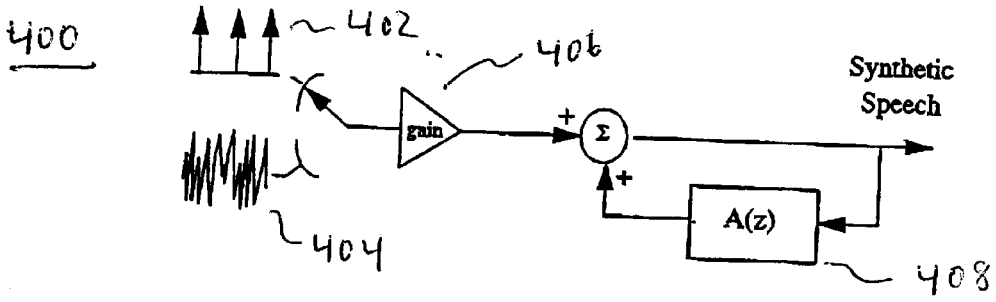
Fig. 4 (PRIOR ART)
FIG. 4 shows a conventional vocoder.

The GSM-VOC decoder includes the basic conceptual configuration shown in FIG. 4. Namely, the GSM-VOC includes functionality for applying an excitation signal comprising either a noise vector (for unvoiced sounds) or a static pulse form (for voiced speech). The excitation is then processed by an LPC filter block to produce a synthesized signal.

In operation, the GSM-VOC encoder divides input speech into frames of 20 ms, and high-pass filters the speech using a filter with a cut-off frequency of 80 Hz. The root mean square (RMS) energy value of the speech is then calculated. The GSM-VOC then calculates and quantifies a single set of LP coefficients using the method set forth in the GSM-EFR standard. (In contrast, however, the GSM-EFR standard described above computes two sets of coefficients.) The GSM-VOC encoder derives the single set of coefficients based on the window having more weight on the last samples, as in the GSM-EFR 06.60 standard. After the encoder finds the LP coefficients, it calculates the residual.

The encoder then performs an open-loop pitch search on each half of the frame. More specifically, the encoder performs this search by calculating the auto-correlation over 80 samples for lags in the range of 18 to 143 samples. The encoder then weights the calculated correlations in favor of small lags. This weighting is done by dividing the span of samples of 18 to 143 into three sectors, namely a first span of 18–35, a second span of 36–71, and a third span of 72–143 samples. The decoder then determines and weights the maximum value from each sector (to favor small lags)

and selects the largest one. Then, the encoder compares the maximum values associated with the two frame halves, and selects the LTP lag of the frame half with the largest correlation. The favorable weighting of small lags is useful to select a primary (basic) lag value when multiples of the lag value are present in the correlation.

Figure 9:
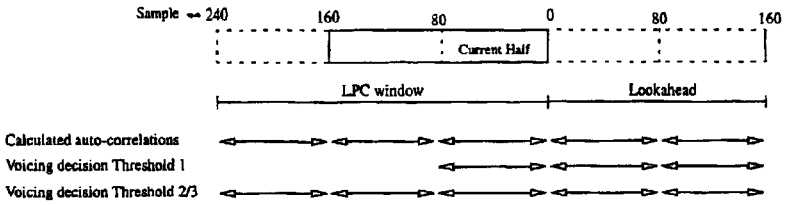
FIG. 9 shows the division of subframes for a redundant encoder in one example of the present invention.

The encoder calculates the voicing based on the unweighted maximum correlation from the open-loop search. More specifically, as shown in FIG. 9, the encoder bases the voicing decision on the sample range spanning the two previous half-frames, the current half-frame, and the next two half-frames (for a total of five correlations). To calculate the correlations for the next frame, the encoder requires a 20 ms look-ahead. The FEC technique provides the look-ahead without adding extra delay to the encoder. Namely, the encoder module combines primary data pertaining to a frame n with redundant data pertaining to an earlier frame, i.e., frame n−1. By encoding the redundant frame n−1 at the same time as the primary frame n, the redundant encoder has access to the look-ahead frame. In other words, the redundant encoder has an opportunity to "investigate" the redundant frame n−1 prior to its redundant-encoding.

To determine if the speech is voiced or not, the encoder compares the five correlations shown to three different thresholds. First, the encoder calculates a median from the present frame and the next two half-frames, and compares the median with a first threshold. The encoder uses the first threshold to quickly react to the start of a voiced segment. Second, the encoder calculates another median formed from all five of the correlations, and then compares this median to a second threshold. The second threshold is lower than the first threshold, and is used to detect voicing during a voiced segment. Third, the encoder determines if the previous half-frame was voiced. If so, the encoder also compares the median formed from all five of the correlations with a third threshold. The third threshold value is the lowest of the three thresholds. The encoder uses the third threshold to extend voiced segments to or past the true point of transition (e.g., to create a "hang-over"). The third threshold will ensure that the encoder will mark the half-frame where the transition from voiced to unvoiced speech occurs as voiced. The information sent to the decoder includes the above-computed voicing for both half-frames.

The encoder uses a modified GSM-EFR 06.60 speech coder technique (or a modified IS-641 technique) to quantize the LP coefficients. As described, GSM-EFR 06.60 describes a predictor which uses a prediction factor based on the previous frame's line spectral frequencies LSFs. In contrast, the predictor of the present technique uses mean LSF values (where the mean values are computed as per the GSM-EFR 06.60 standard). This eliminates dependencies on the previous frame in quantizing the LPCs. The technique groups three vectors based on residuals (e.g., 10 residuals) from the prediction. The technique then compares the vectors with a statistically produced table to determine the best match. An index of the table representing the best match is returned. The three indices corresponding to the three vectors use 26 bits.

Further, the encoder converts the RMS value into dB and then linear quantizes it using seven bits, although fewer bits can be used (e.g., five or six bits). The voicing state uses two bits to represent the voicing in each half-frame. The pitch has a range of (18 to 143) samples. A value of 18 is subtracted so that the valid numbers fit into seven bits (i.e., to provide a range of 0 to 125 samples).

Table 1 below summarizes the above-discussed bit allocation in the GSM-VOC.

TABLE 1

| Parameter | Number of Bits |
|---|---|
| LPC | 26 |
| Pitch Lag | 7 |
| RMS Value | 7 |
| Voicing State | 2 |
| Pitch Pulse Position | 8 |
| Pitch Pulse Sign | 1 |
| Total (Bandwidth) | 51 (2550 b/s) |

The pitch pulse position and its signal provide useful information for performing the FEC technique. These parameters indicate, with a resolution of one sample, the starting position of the pitch pulse in a frame. Use of this information allows the technique to keep the excitation and its synthesis in phase with the original speech. These parameters are found by first correlating the residual and a fixed pulse form. The position and sign are then located in the correlation curve with the help of the voicing decision, which is used to identify the correct frame half (e.g., the voicing decision could be used to rule out a detected "false" pulse in an unvoiced frame half). By contrast, a stand-alone encoder (i.e., an encoder not coupled with another encoder for performing FEC) does not specify any information pertaining to pulse position (i.e., pulse phase). This is because the pitch phase is irrelevant in a stand-alone vocoder as long a pitch epoch has the given pitch lag distance.

Turning now to the decoder, the GSM-VOC decoder creates an excitation vector from the voicing decision and pitch. The voicing has six different states, including two steady states and four transitions states. The steady states include a voiced state and an unvoiced state. The transition states include a state pertaining to the transition from an unvoiced state to a voiced state, and a state pertaining to the transition from a voiced state to an unvoiced state. These transition states occur in either half of the frame, thus defining the four different states. For voiced parts of the frame, the decoder uses the given pitch to determine the epochs that are calculated (where the term "epochs" refers to sample spans corresponding, e.g., to a pitch period). On the other hand, the decoder divides unvoiced frames into four epochs of 40 samples each for interpolation purposes.

For each pitch epoch, the decoder interpolates the old and new values of RMS and pitch (i.e., from the previous frame and current frames, respectively) to provide softer transitions. Furthermore, for voiced speech, the decoding technique creates an excitation from a 25 sample-long pulse and low intensity noise. For unvoiced speech, the excitation signal includes only noise. More specifically, in a voiced pitch epoch, the decoder low-pass filters the pulse and high-pass filters the noise. A filter defined by $1+0.7\alpha A(z)$ then filters the created excitation, where a is the gain of A(z). This reduces the peaked nature of the synthetic speech, as discussed in Tremain, T., "The Government Standard Linear Predictive Coding Algorithm: LPC-10," Speech Technology, April 1982, pp. 40–48. The decoder adds a plosive for unvoiced frames where the RMS value is increased more than eight times the previous frame's value. The position of the plosive is random in the first unvoiced pitch epoch and consists of a double pulse formed by a consecutive positive (added) and negative (subtracted) pulse. The double pulse provides the maximum response from the filter. Then the technique adjusts the RMS value of the epoch to match the interpolated value (e.g., an interpolated RMS value formed from the RMS values from the past, current, and, if available, next frame). This is done by calculating the present RMS value of a synthesis-filtered excitation.

The decoder then interpolates the LPCs in the LSF domain for each 40 sample subframe and then applies the result to the excitation. The pulse used for voiced excitation includes bias. A high-pass filter removes this bias using a cut-off frequency of 80 Hz.

Having set forth the features of the GSM-VOC redundant encoder and decoder, the operation of the overall FEC technique using GSM-EFR (for primary encoding and decoding) and GSM-VOC (for redundant encoding and decoding) will now be described.

2.2 Utilizing the Primary and Redundant Coders in FEC

Figure 10:
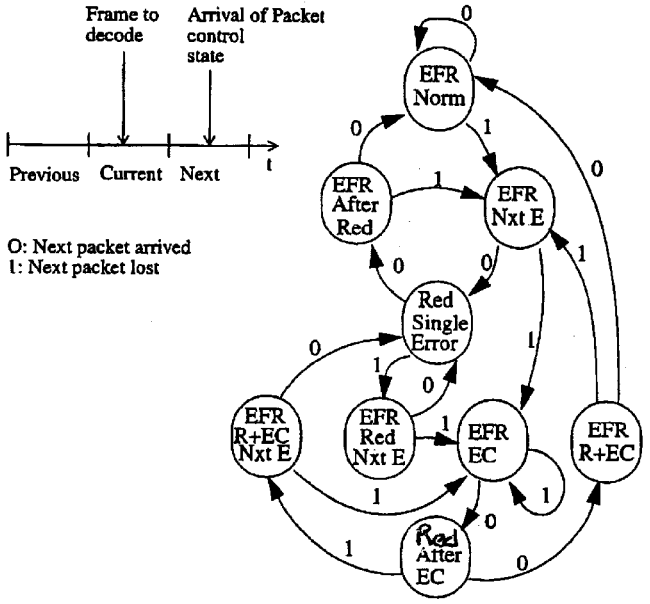
FIG. 10 shows an example of a state machine for use in the control logic of the decoder module shown in FIG. 7.

FIG. 10 shows a state diagram of the state machine provided in control logic 718 (of FIG. 7). The arrival or non-arrival of each packet prompts the state machine to transition between states (or to remain in the same state). More specifically, the arrival of the next packet defines a transition labeled "0" in the figure. The non-arrival of the next packet (i.e., the loss of a packet) defines a transition labeled "1" in the figure. The characteristics of the states shown in FIG. 10 are identified below.

State: EFR Norm

State "EFR Norm" indicates that the decoder module has received both the current packet and the next packet.

The decoder module decodes speech using the primary decoder according to the standard protocol set forth in, e.g., GSM-EFR 06.60.

State: EFR Nxt E

State "EFR Nxt E" indicates that the decoder module has received the current packet, but not the next packet (note that the state diagram in FIG. 10 labels the transition from state "EFR Norm" to "EFR Nxt E" as "1," indicating that a packet has been lost).

In this state, the decoder module decodes the speech as in state "EFR Norm." But because the redundant data for this frame is missing, no RMS parameter value is provided. Hence, the decoder module calculates the RMS value and enters it into history. Similarly, because the voicing state parameter is not available, the decoder module calculates the voicing of the frame (e.g., from the generated synthesized speech) by taking the maximum of the auto-correlation and feeding it to the voicing decision module used in the encoder. As no look-ahead is used, a less accurate decision may result.

State: Red Single Error

State "Red Single Error" indicates that the decoder module has not received the current frame's primary data (i.e., the primary data is lost), but has received the next frame's packet carrying redundant data for the current frame.

In this state, the decoder module decodes the speech using the redundant data for the current frame and primary data for the next frame. More specifically, the decoder module decodes the LPCs for subframe four of the current frame from the redundant frame. The decoded values are then used to update the predictor of the primary LPC decoder (i.e., the predictor for the quantization of the LPC values). The decoder module makes this updating calculation based on the previous frame's LSF residual (as will be discussed in further detail below with respect to state "ERF R+C"). The use of redundant data (rather than primary) may introduce a quantization error. The decoder module computes the other subframe's LPC values by interpolated in the LSF domain between decoded values in the current frame and the previous frame's LPCs.

The coding technique extracts the LTP lag, RMS value, pitch pulse position, and pitch pulse sign, and decodes the extracted values into decoded parametric values. The technique also extracts voicing decisions from the frame for use in creating a voicing state. The voicing state depends on the voicing decision made in the previous half-frame, as well as the decision in the two current half-frames. The voicing state controls the actions taken in constructing the excitation.

Decoding in this state also makes use of the possibility of pre-fetching primary data. More specifically, the decoder module applies error correction (EC) to LTP gain and algebraic codebook (Alg CB) gain for the current frame (comprising averaging and attenuating the gains as per the above-discussed GSM 06.61 standard). The decoder module then decodes the parameters of the next frame when the predictor and histories have reacted to the current frame. These values are used for predicting the RMS of the next frame. More specifically, the technique performs the prediction by using mean LTP gain (i.e., $LTP_{gain,\ mean}$), the previous RMS value (prevRMS), and the energy of the Alg CB vector with gain applied (i.e., RMS(AlgCB Alggain)), according to the following equation:

$$\hat{RMS}=[LTP_{gain,mean}\cdot prevRMS^2+(RMS(AlgCB\cdot Alggain))^2]^{1/2} \quad \text{(Eq. 12).}$$

In frames with voicing state representing steady-state voiced speech, the decoder module creates the excitation in a different manner than the other states. Namely, the decoder module creates the excitation in the manner set forth in the GSM-EFR standard. The module creates the LTP vector by interpolating the LTP lags between the values from the redundant data and the previous frame, and copying the result in the excitation history. This is performed only if the difference between the values from the redundant data and the previous frame is below a prescribed threshold, e.g., less the eight. Otherwise, the decoding module uses the new lag in all subframes (from the redundant data). The module performs the threshold check to avoid interpolating a gap that results from the encoder choosing a two-period long LTP lag. The technique randomizes the Alg CB to avoid ringing, and calculates the gain so the Alg CB vector has one tenth of the gain value of the LTP vector.

The decoder module forms the excitation by summing the LTP vector and the Alg CB vector. The decoder module then adjusts the excitation vector's amplitude with an RMS value for each subframe. Such adjustment on a subframe basis may not represent the best option, because the pitch pulse energy distribution is not even. For instance, two high-energy parts of pitch pules in a subframe will receive a smaller amplitude compared to one high-energy part in a subframe. To avoid this non-optimal result, the decoder module can instead perform adjustment on a pitch pulse-basis. The technique interpolates the RMS value in the first three subframes between the RMS value in the last subframe in the previous frame and the current frame's RMS value. In the last subframe of the current frame, the technique interpolates the RMS value between the current frame's value and the predicted value of the next frame. This results in a softer transition into the next frame.

In frames with other voicing states than the steady-state voiced state, the decoder module creates the excitation in a GSM-VOC-specific manner. Namely, in a steady-state unvoiced state, the excitation constitutes noise. The decoder module adjusts the amplitude of the noise so that the subframes receive the correct RMS. In transitions to an unvoiced state, the coding technique locates the position of the last pitch pulse by correlating the previous frame's synthesis with a pulse form. That is, the technique successively locates the next local pulse maximum from the correlation maximum using steps of LTP lag-size until it finds the last possible maximum. The technique then updates the vocoder excitation module to start at the end of the last pulse, somewhere in the current frame. Further, the coding technique copies the missing samples from the positions just before the start of the last pulse. If this position does not lie beyond the position where the unvoiced segment starts, the decoder module adds one or more vocoder pulses, and interpolates RMS values towards the frame's value. From the end of the last voiced pulse, the decoder module generates noise to the frame boundary. The decoder module also interpolates the noise RMS so that the technique provides a soft transition to an unvoiced condition.

If the voicing state represents a transition to a voiced state, the coding technique relies crucially on pulse position and sign. The excitation consists of noise until the given pitch pulse position. The decoder module interpolates this noise's RMS toward the received value (from the redundant data). The technique places the vocoder pulse at the pitch pulse position, with an interpolated RMS value. All pulses use the received lag. The technique forms the RMS interpolation between the value of the previous frame's last subframe and the received value in the first half of the frame and between the received value and the predicted value in the second half.

When calculating the RMS value for the excitation, the decoder module synthesis-filters the excitation with the correct filter states to take into account the filter gain. After the adjustment of the energy, the technique high-pass filters the excitation to remove the biased part of the vocoder pulse. Further, the decoder module enters the created excitation in the excitation history to give the LTP something to work with in the following frame. The decoder module then applies the synthesis model a final time to create the synthesis. The synthesis from a steady-state voiced state is also post-filtered.

State: EFR After Red

In state "EFR After Red," the decoder module has received the current and next frames' packets, although the decoder module used only redundant data to decode the previous frame.

In this state, the technique uses conventional GSM-EFR decoding. However, the decoder module uses gain parameters that have already been decoded. The created synthesis has its amplitude adjusted so that the RMS value of the entire frame corresponds to the received value from the redundant data. To avoid discontinuities in the synthesis that can produce high frequency noise, the decoder module performs the adjustment on the excitation. The module then feeds the excitation into the excitation history for consistency with the next frame. Further, the module resets the synthesis filter to the state it initially had in the current frame, and then uses the filter on the excitation signal again.

State: EFR Red Nxt E

In the state "EFR Red Nxt E," the decoder module has received the current frame's primary data, but has not received the next frame's packet (i.e., the next packet has been lost). Further, the decoder module decoded the previous frame using redundant data.

This state lacks redundant data for use in correcting the energy level of the synthesis. Instead, the decoder module performs prediction using equation 12.

State: EFR EC

In state EFR EC, the decoder module has failed to receive multiple packets in sequence. Consequently, neither primary nor redundant data exist for use in decoding speech in the current frame.

This state attempts to remedy the lack of data using GSM-EFR error concealment techniques (e.g., described in the Background section). This includes taking the mean of the gain histories (LTP and Alg CB), attenuating the mean values, and feeding the mean values back into the history. Because the data are lost instead of distorted by bit errors, the decoder module cannot use the algebraic codebook vector as received. Accordingly, the decoder module randomizes a new codebook vector. This method is used in GSM-EFR adapted for packet-based networks. If, in contrast, the decoder module copied the vector from the last frame, ringing in the speech might occur. The coding technique calculates the RMS value and voicing state from the synthesized speech as in state "EFR nxt E." The use of the last good frame's pitch can result in a large phase drift of pulse positions in the excitation history.

State: Red after EC

In state "Red after EC," the decoder module has received the next frame's packet containing the current frame's redundant data. The decoder module applied error correction to one or more prior frames (and this state is distinguishable from state "Red Single Error" on this basis).

In this state, the excitation history is very uncertain and should not be used. The decoder module creates the excitation in steady-state voiced state from the vocoder pitch pulse, and the decoder module interpolates the RMS energy from: the previous frame's value, the current value, and the prediction for the next frame. The decoder module takes the position and sign of the pulses from the received (redundant) data to render the phase of the excitation history as accurate as possible. The decoder module copies the points before the given position from the excitation history in a manner relating to the processing of the steady-state voiced state of the "Red Single Error" state. (If the redundant data were to lack the pitch pulse phase information, the pitch pulse placement could be determined using the first-mentioned technique discussed in Section No. 1.4 above.)

State: ERF R+EC Nxt E

In state "EFR R+EC Nxt E," the decoder module fails to receive the next frame's packet. Further, the decoder module decoded the previous frame with only redundant data, and the frame prior to that with EC.

The decoder module decodes the current frame with primary data. But this state represents the worst state among the class of states which decode primary data. For instance, the LSF-predictor likely performs poorly in this circumstance (e.g., the predictor is "out-of-line") and cannot be corrected with the available data. Therefore, the decoder module decodes the GSM-EFR LPCs in the standard manner and then slightly bandwidth expands the LPCs. More specifically, this is performed in the standard manner of GSM-EFR error correction, but to a lesser extent to avoid creating another type of instability (e.g., the filters will become unstable by using the mean too much). The decoder module performs the energy adjustment of the excitation and synthesis against a predicted value, e.g., with reference to Eq. 12. Afterwards, the decoder module calculates the RMS and voicing for the current frame from the synthesis.

State: ERFR+EC

In state "ERF R+EC," the decoder module has received the next frame's packet, but it decoded the previous frame with only redundant data, and the frame prior to that with EC.

In this state, the decoder module generally decodes the current frame using primary and redundant data. More specifically, after EC has been applied to the LP coefficients, the predictor loses its ability to provide accurate predictions.

In this state, the decoder module can be corrected with the redundant data. Namely, the decoder module decodes the redundant LPC coefficients. These coefficients represent the same value as the second series of LPC coefficients provided by the GSM-EFR standard. The coding technique uses both to calculate an estimate of the predictor value for the current frame, e.g., using the following equations. (Eq. 13 is the same as Eq. 11, reproduced here for convenience.)

$$LSF_{prev,res}=(LSF_{red}-LSF_{mean}-LSF_{res})/\text{predFactor}. \quad \text{(Eq. 13)}$$

$$LSF=LSF_{res}+LSF_{mean}+\text{predFactor}\cdot LSF_{prev,res} \quad \text{(Eq. 14)}$$

In the present approach, the primary synthesis model provides information pertaining to LSF residuals (i.e, $LSF_{res}$), while the redundant model provides information pertaining to redundant LSF values for these coefficients (i.e., $LSF_{red}$.). The decoder module uses these values to calculate the predictor state using Eq. 13 to provide a quick predictor update. In Eq. 13, the term $LSF_{mean}$ defines a mean LSF value, the term predFactor refers to a prediction factor constant, and $LSF_{prev,res}$ refers to a residual LSF from the past frame. The decoder module then uses the updated predictor state to decode the LSF residuals to LPC coefficients using Eq. 14 above. This estimation advantageously ensures that the LP coefficients for the current frame have an error equal to the redundant LPC quantization error. The predictor would otherwise have been correct in the next frame when it had been updated with the current frame's LSF residuals.

The GSM-EFR standard provides another predictor for algebraic codebook gain. The values of the GSM-EFR gain represent rather stochastic information. No available redundant parameter matches such information, preventing the estimation of the Alg CB gain. The predictor takes approximately one frame before it becomes stable after a frame loss. The predictor could be updated based on energy changes present between frames. The encoder module could measure the distribution (e.g., ratio) between the LTP gain and the algebraic gain and send it with very few bits, e.g., two or three. The technique for updating the predictor should also consider the voicing state. In the transition to the voiced state, the algebraic gain is often too large to build up a history for the LTP to use in later frames. In steady-state, the gain is more moderate, and for the unvoiced state it produces most of the randomness found in the unvoiced state.

2.4 Variations

A number of variations of the above-described example are envisioned. For example, the RMS measure in the last subframe could be changed to measure the last complete pitch epoch so that only one pitch pulse is measured. With the current measure over the last subframe, zero, one or two high energy parts may be present depending on the pulse's position and the pitch lag. A similar modification is possible for the energy distribution in the state "Red Single Error" and the steady-state voiced state. In these cases, the energy interpolation can be adjusted based on the amount of pitch pulses.

The pulse position search in the encoder module can be modified so that it uses the voicing decision based on look-ahead.

When in the error state "Red after EC," the technique can adjust the placing of the first pitch pulse. This adjustment should consider both the received pulse position and the phase information in the previous frame's synthesis. To minimize phase discontinuities, the technique should use the entire frame to correct the phase error. This assumes that the previous frame's synthesis consists of voiced speech.

Interpolation using polynomial techniques can replace linear interpolation. The technique should match the polynomial to the following values: previous frame's total RMS, RMS for the previous frame's last pulse, current frame's RMS, and next frame's predicted RMS.

The technique can employ a more advanced prediction of the energy. For instance, there exists enough data to determine the energy envelope for the next frame. The technique can be modified to predict the energy and its derivative at the start of the next frame from the envelope. The technique can use this information to improve the energy interpolation to provide an even softer frame boundary. In the event that the technique provides a slightly inaccurate prediction, the technique can adjust the energy level in the next frame. To avoid discontinuities, the technique can use some kind of uneven adjustment. For instance, the technique can set the gain adjustment to almost zero in the beginning of a frame and increase the adjustment to the required value by the middle of the frame.

To reduce the amount of redundant data (overhead) transmitted over the network, the coding technique can discard some parameters. More specifically, the technique can discard different parameters depending on the voicing state.

For instance, Table 2 identifies parameters appropriate for unvoiced speech. The technique requires the LPCs to shape the spectral properties of the noise. The technique needs the RMS value to convey the energy of the noise. The table lists voicing state, but this parameter can be discarded. In its place, the technique can use the data size as an indicator of unvoiced speech . That is, without the voicing state, the parameter set in Table 2 provides a frame size of 33 bits and a bit rate of 1650 b/s. This data size (33 bits) can be used as an indicator of unvoiced speech (in the case where the packetizing technique specifies this size information, e.g., in the header of the packets). Additionally, the coding technique may not require precise values for use in spectral shaping of the noise (compared to voiced segments). In view thereof, the technique may use a less precise type of quantization to further reduce the bandwidth. However, such a modification may impair the effectiveness of the predictor updating operation for the primary LPC decoder.

TABLE 2

| Parameter | Number of Bits |
|---|---|
| LPC | 26 |
| RMS Value | 7 |
| Voicing State | 2 |
| Total (Bandwidth) | 35 (1750 b/s) |

In transitions from unvoiced to voiced speech, the technique requires all the parameters in Table 1 (above). This is because the LPC parameters typically change in a drastic manner in this circumstance. The voiced speech includes a pitch, and a new level of energy exists in the frame. The technique thus uses the pitch pulse and sign to generate a correct phase for the excitation.

In steady-state voiced state, and in transitions to the unvoiced state, the technique can remove the pitch pulse position and sign, thus reducing the total bit amount to 42 bits (i.e., 2100 b/s). The decoder module accordingly receives no phase information in these frames, which may have a negative impact on the quality of its output. This will force the decoder to search the phase in the previous frame, which, in turn, can result in larger phase errors since the algorithm can not detect the phase due to loss of a burst of packets. It also makes it impossible to correct any phase drift that has occurred during a period of error concealment.

Instead of the above-described GSM-VOC, the redundant decoder described above can use multi-pulse coding. In multi-pulse decoding, the coding technique encodes the most important pulses from the residual. This solution will react better to changes in transitions from unvoiced to voiced states. Further, no phase complication will arise when combining this coding technique with GSM-EFR. On the other hand, this technique uses a higher bandwidth than the GSM-VOC described above.

The example described above provides a single level of redundancy. However, the technique can use multiple levels of redundancy. Further, the example described above preferably combines the primary and redundant data in the same packet. However, the technique can transfer the primary and redundant data in separate packets or other alternative formats.

Other variations of the above described principles will be apparent to those skilled in the art. All such variations and modifications are considered to be within the scope and spirit of the present invention as defined by the following claims.

What is claimed is:

1. A decoder module for decoding audio data formatted into packets containing primary-encoded data and redundant-encoded data, comprising:

a primary decoder for decoding the packets using a primary synthesis model;

a redundant decoder for decoding the packets using a redundant synthesis model; and control logic for selecting, for each packet, one of plural decoding strategies for use in decoding the packet depending on an error condition experienced by the decoder module, wherein, in one strategy, the redundant synthesis model is used to update a state in the primary synthesis model, and/or the primary synthesis model is used to update a state in the redundant synthesis model.

2. A decoder module for decoding audio data according to claim 1, wherein the state pertains to at least one of:

an adaptive codebook state;

an LPC filter state;

an error concealment history state; and a quantization predictor state.

3. A decoder module for decoding audio data according to claim 1, wherein the state pertains to an LSF-predictor state in the primary synthesis model, which is updated using the equation:

$$LSF_{pres,res}=(LSF_{red}-LSF_{mean}-LSF_{res})/\text{predFactor},$$

where $LSF_{pres,res}$ refers to the LSF residual of a previous frame, $LSF_{red}$ refers to the LSF of a current frame supplied from redundant data, $LSF_{mean}$ refers to a mean LSF of the current frame, $LSF_{res}$ refers to the LSF residual of the current frame, and predFactor refers to a prediction factor.

4. A decoder module for decoding audio data according to claim 1, wherein the error condition pertains to the receipt or non-receipt of a previous packet, the receipt or non-receipt of a current packet, and the receipt or non-receipt of a next packet.

5. A decoder module for decoding audio data containing primary-encoded data and redundant-encoded data, wherein the primary-encoded data and the redundant-encoded data are combined into a series of packets, such that, in each packet, primary-encoded data pertaining to a current frame is combined with redundant-encoded data pertaining to a previous frame, comprising:

a primary decoder for decoding the packets using a primary synthesis model, a redundant decoder for decoding the packets using a redundant synthesis model;

look-ahead means for processing primary-encoded data contained in a packet while decoding the redundant-encoded data also in that packet; and means for using results of the look-ahead processing means to predict the energy in a next frame and to smooth the energy transition between frames.

6. A decoder module for decoding audio data formatted into packets containing primary-encoded data and redundant-encoded data, comprising:

a primary decoder for decoding the packets using a primary synthesis model;

a redundant decoder for decoding the packets using a redundant synthesis model; and means for locating a pitch pulse position in a current frame by locating the last known pulse position in a previous frame, and then advancing from the last known pulse position by one or more pitch lag values to locate the pulse position in the current frame, wherein the located pitch pulse position in the current frame is used to reduce phase discontinuities.

7. A decoder module for decoding audio data according to claim 6, wherein the means for locating the pitch pulse is further configured to receive a pitch pulse position value from an encoding site, compare the received value with the located pitch pulse position, and then to smooth out any detected phase discrepancies over the course of the current frame.

8. An encoder module for encoding audio data, comprising:

a primary encoder for encoding an input audio signal using a primary synthesis model to produce primary-encoded data;

a redundant encoder for encoding the Input audio signal using a redundant synthesis model to produce redundant-encoded data;

a packetizer for combining the primary-encoded data and the redundant-encoded data into a series of packets, wherein the packetizer combines, in a single packet, primary-encoded data pertaining to a current frame with redundant-encoded data pertaining to a previous frame, and wherein the primary encoder encodes the current frame at the same time that the redundant encoder encodes the previous frame, and look-ahead means for processing data to be encoded by the redundant encoder prior to encoding wherein said look-ahead means uses results of its processing to improve a voicing decision regarding the redundant-encoding data.

9. A method for decoding audio data formatted into packets containing primary-encoded data and redundant-encoded data, comprising the steps of:

receiving the packets at a decoding site;

primary-decoding the received packets using a primary synthesis model;

redundant-decoding the received packets using a redundant synthesis model; and selecting, for each packet, one of plural decoding strategies for use in decoding the packet depending on an error condition experienced at the decoder site, wherein, in one strategy, the redundant synthesis model is used to update a state in the primary synthesis model, and/or the primary synthesis model is used to update a state in the redundant synthesis model.

10. A method for decoding audio data according to claim 9, wherein the state pertains to at least one of:

an adaptive codebook state;

an LPC filter state;

an error concealment history state; and a quantization predictor state.

11. A method for decoding audio data according to claim 9, wherein the state pertains to an LSF-predictor state in the primary synthesis model, which is updated using the equation:

$LSF_{pres,res}=(LSF_{red}-LSF_{mean}-LSF_{res})/\text{predFactor}$, where $LSF_{pres,res}$ refers to the LSF residual of a previous frame, $LSF_{red}$ refers to the LSF of a current frame supplied from redundant data, $LSF_{mean}$ refers to a mean LSF of the current frame, $LSF_{res}$ refers to the LSF residual of the current frame, and predFactor refers to a prediction factor.

12. A method for decoding audio data according to claim 9, wherein the error condition pertains to the receipt or non-receipt of a previous packet, the receipt or non-receipt of a current packet, and the receipt or non-receipt of a next packet.

13. A method for decoding audio data containing primary-encoded data and redundant-encoded data, wherein the primary-encoded data and the redundant-encoded data are combined into a series of packets, such that, in each packet, primary-encoded data pertaining to a current frame is combined with redundant-encoded data pertaining to a previous frame, comprising: comprising the steps of:

receiving the packets at a decoding site;

primary-decoding the received packets using a primary synthesis model;

redundant-decoding the received packets using a redundant synthesis model;

look-ahead processing primary-encoded data contained in a packet while decoding the redundant-encoded data also in that packet; and using results of the look-ahead processing to predict the energy of a next frame and to smooth the energy transition between frames.

14. A method for decoding audio data formatted into packets containing primary-encoded data and redundant-encoded data, comprising:

primary-decoding the packets using a primary synthesis model;

redundant-decoding the packets using a redundant synthesis model;

wherein the primary-decoding or redundant decoding comprises the step of locating a pitch pulse position in a current frame by locating the last known pulse position in a previous frame, and then advancing from the last known pulse position by one or more pitch lag values to locate the pulse position in the current frame, wherein the located pitch pulse position is used to reduce phase discontinuities.

15. A method for decoding audio data according to claim 14, wherein the step of locating the pitch pulse position further comprises receiving a pitch pulse position value from an encoding site, comparing the received value with the located pitch pulse position, and then smoothing out any detected phase discrepancies over the course of the current frame.

16. A method for encoding audio data, comprising:

primary-encoding an input audio signal using a primary synthesis model to produce primary-encoded data;

redundant-encoding the input audio signal using a redundant synthesis model to produce redundant-encoded data;

combining the primary-encoded data and the redundant-encoded data into a series of packets, wherein the packetizer combines, in a single packet, primary encoded data pertaining to a current frame with redundant-encoded data pertaining to a previous frame, and wherein the primary-encoding of the current frame takes place at the same time that the redundant-encoding of the previous frame, look-ahead processing data to be encoded by the redundant encoder prior to encoding; and using results of the look-ahead processing to improve a voicing decision regarding the redundantly-encoding data.

* * * * *

UNITED STATES PATENT AND TRADEMARK OFFICE

CERTIFICATE OF CORRECTION

PATENT NO. : 6,757,654 B1
APPLICATION NO. : 09/569312
DATED : June 29, 2004
INVENTOR(S) : Westerlund et al.

It is certified that error appears in the above-identified patent and that said Letters Patent is hereby corrected as shown below:

The Title Page showing an illustrative figure, should be deleted and substitute therefor the attached title page.

On the Title Page, item (56), under "U.S. PATENT DOCUMENTS", in Column 1, Line 10, delete "Matsumura et al." and insert -- Schuster --, therefor.

On the Title Page, item (56), under "OTHER PUBLICATIONS", in Column 2, Line 4, delete "Apr. 27-30 1993, page: 361-364 vol.1." and insert -- Apr. 27-30, 1993, Page(s): 361-364, vol.1. --, therefor.

On Page (2), item (56), under "OTHER PUBLICATIONS", in Column 1, Line 3, delete "MAy" and insert -- May --, therefor.

Figure 5:
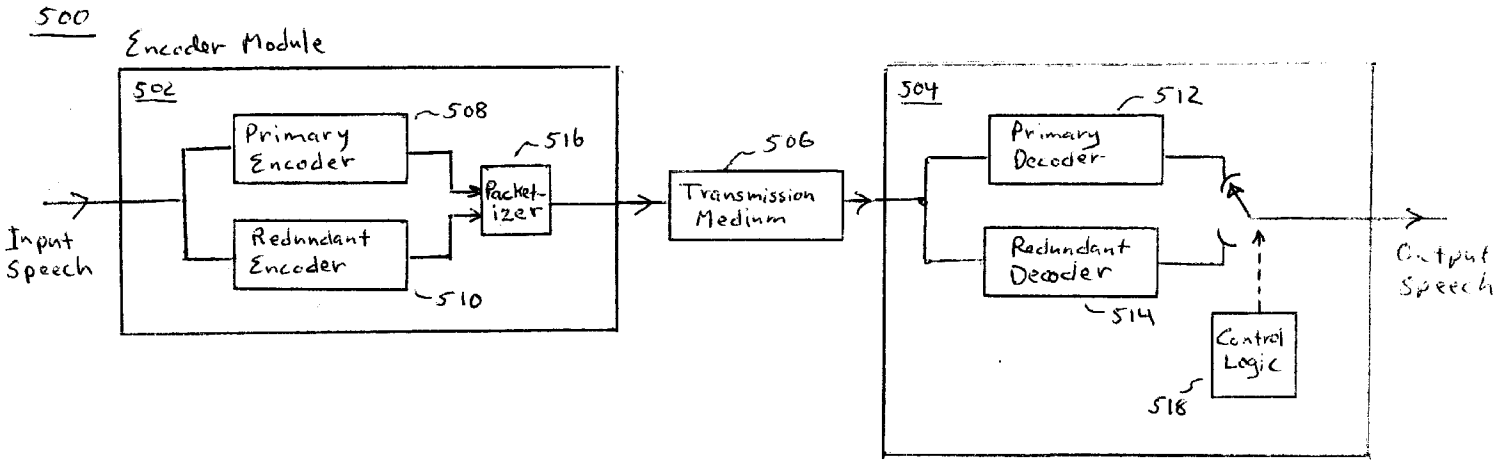
Fig. 5 (PRIOR ART)
FIG. 5 shows a conventional system for performing forward error correction in a packetized network.

In Fig. 5, Sheet 3 of 5, above "Box 504" insert -- Decoder Module --.

In Fig. 7, Sheet 4 of 5, above "Box 704" insert -- Decoder Module --.

In Column 7, Line 46-59, after "delay."" delete "In the prior art .....PCM-encoded stream." and insert the same on line 47 as a new paragraph.

In Column 18, Line 23, delete "(i.e., RMS(AlgCB Alggain))," and insert -- (i.e., RMS(AlgCB · Alggain)), --, therefor.

In Column 18, Line 26, delete " 1/2(Eq. 12). " and insert -- ½ (Eq. 12). --, therefor.

In Column 21, Line 17, delete "(i.e., $LSF_{red}$.)." and insert -- (i.e., $LSF_{red}$). --, therefor.

In Column 24, Line 4, in Claim 5, after "model" delete "," and insert -- ; --, therefor.

UNITED STATES PATENT AND TRADEMARK OFFICE

CERTIFICATE OF CORRECTION

PATENT NO. : 6,757,654 B1
APPLICATION NO. : 09/569312
DATED : June 29, 2004
INVENTOR(S) : Westerlund et al.

It is certified that error appears in the above-identified patent and that said Letters Patent is hereby corrected as shown below:

In Column 24, Line 41, in Claim 8, delete "Input" and insert -- input --, therefor.

Signed and Sealed this

Twenty-eighth Day of October, 2008

JON W. DUDAS
*Director of the United States Patent and Trademark Office*

(12) United States Patent
Westerlund et al.

(10) Patent No.: US 6,757,654 B1
(45) Date of Patent: Jun. 29, 2004

(54) FORWARD ERROR CORRECTION IN SPEECH CODING

(75) Inventors: Magnus Westerlund, Kista (SE); Anders Nohlgren, Luleå (SE); Jonas Svedberg, Luleå (SE); Anders Uvlilden, Luleå (SE); Jim Sundqvist, Luleå (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 09/569,312

(22) Filed: May 11, 2000

(51) Int. Cl.[7] ..... G10L 13/02

(52) U.S. Cl. ..... 704/262; 704/258; 704/219; 704/220

(58) Field of Search ..... 704/262, 219, 704/220, 258, 270, 221, 229

(56) References Cited

U.S. PATENT DOCUMENTS

| | | | | | |
|---|---|---|---|---|---|
| 4,360,708 | A | * | 11/1982 | Taguchi | 704/229 |
| 4,742,519 | A | * | 5/1988 | Abe | 714/755 |
| 4,802,171 | A | * | 1/1989 | Rasky | 714/747 |
| 5,079,771 | A | * | 1/1992 | Shimada | 714/789 |
| 5,323,424 | A | * | 6/1994 | Fazel et al. | 375/329 |
| 5,568,061 | A | * | 10/1996 | McClure | 326/13 |
| 5,598,506 | A | * | 1/1997 | Wigren | 704/233 |
| 5,701,311 | A | * | 12/1997 | Kapoor | 714/748 |
| 5,717,819 | A | * | 2/1998 | Emeott | 704/221 |
| 5,870,412 | A | * | 2/1999 | Matsumura et al. | 714/52 |
| 5,878,387 | A | * | 3/1999 | Oshikiri | 704/207 |

FOREIGN PATENT DOCUMENTS

| | | |
|---|---|---|
| WO | WO00/18057 | 3/2000 |

OTHER PUBLICATIONS

Shrimali, G and Parhi, K.K. High–speed Arithmetic Coder/Decoder Architectures, Acoustics, Speech, and Signal Processing, 1993. ICASSP–93., 1993 IEEE International Conference on, vol.: 1, Apr. 27–30 1993, page: 361–364 vol. 1.*

Perkins, C., et al., "A Survey of Packet Loss Recovery Techniques for Streaming Audio", IEEE Network: The Magazine of Computer Communications, vol. 12, No. 5, Sep. 1998, pps. 40–48, XP002133605.

(List continued on next page.)

*Primary Examiner*—Richemond Dorvil
*Assistant Examiner*—Kinari Patel

(57) ABSTRACT

An improved forward error correction (FEC) technique for coding speech data provides an encoder module which primary-encodes an input speech signal using a primary synthesis model to produce primary-encoded data, and redundant-encodes the input speech signal using a redundant synthesis model to produce redundant-encoded data. A packetizer combines the primary-encoded data and the redundant-encoded data into a series of packets and transmits the packets over a packet-based network, such as an Internet Protocol (IP) network. A decoding module primary-decodes the packets using the primary synthesis model, and redundant-decodes the packets using the redundant synthesis model. The technique provides interaction between the primary synthesis model and the redundant synthesis model during and after decoding to improve the quality of a synthesized output speech signal. Such "interaction," for instance, may take the form of updating states in one model using the other model.

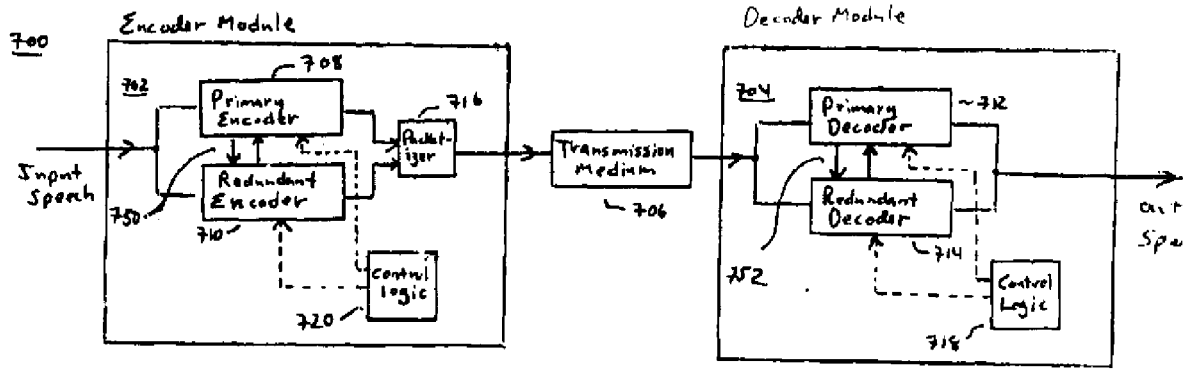

16 Claims, 5 Drawing Sheets